US005771584A

United States Patent [19]

Wang

[11] Patent Number: 5,771,584

[45] Date of Patent: Jun. 30, 1998

[54] SHEAR WITH LINK INTERCONNECTED HANDLES

[76] Inventor: Meng Tun Wang, No. 9-4-1, Chung Nan Lane, Tai Ping City, Taichung Hsien, Taiwan

[21] Appl. No.: 821,230

[22] Filed: Mar. 20, 1997

[51] Int. Cl.[6] ..... B26B 13/26

[52] U.S. Cl. ..... 30/251; 30/190; 81/383

[58] Field of Search ..... 30/251, 250, 249, 30/257, 190, 188, 252; 81/383, 362, 375, 376, 378

[56] References Cited

U.S. PATENT DOCUMENTS

| | | | |
|---|---|---|---|
| Re. 30,613 | 5/1981 | Nakamura et al. | 30/190 X |
| 2,503,783 | 4/1950 | Ward | 81/376 X |
| 2,528,816 | 11/1950 | Boyer | 30/190 X |
| 5,020,222 | 6/1991 | Gosselin et al. | 30/251 |
| 5,280,716 | 1/1994 | Ryan et al. | 81/383 X |

*Primary Examiner*—Douglas D. Watts

[57] ABSTRACT

A shear device includes a hand grip and a handle pivotally coupled together. A bar has one end pivotally coupled to the handle. A cutter blade has a middle portion pivotally coupled to the hand grip and has a pin secured to one end. A lever has one end pivotally coupled to the hand grip at a pivot rod and has the other end pivotally coupled to the bar at a pivot pole and has a groove formed in the middle portion for slidably engaging with the pin. The pin is disposed between the pivot pole and the pivot rod for allowing the cutter blade to be rotated with less force.

1 Claim, 4 Drawing Sheets

SHEAR WITH LINK INTERCONNECTED HANDLES

BACKGROUND OF THE INVENTION

1. Field of the Invention

The present invention relates to a shear, and more particularly to a shear device for conducting variable force compound action.

2. Description of the Prior Art

A typical shear device is disclosed in U.S. Pat. No. 5,020,222 to Gosselin et al. Though the leverage may be changed, the force applied onto the cutter blade is inclined and a large portion of the force may not be used for operating the cutter blade. The shear device is not good for weak people.

The present invention has arisen to mitigate and/or obviate the afore-described disadvantages of the conventional shear devices.

SUMMARY OF THE INVENTION

The primary objective of the present invention is to provide a shear device which may be operated with less force and may be easily operated by weak people or children.

In accordance with one aspect of the invention, there is provided a shear device comprising a body including a first end having a fixed jaw and including a middle portion and including a second end having a hand grip, a handle pivotally coupled to the body for moving toward and away from the hand grip, a bar including a first end pivotally coupled to the handle and including a second end, a cutter blade including a middle portion pivotally coupled to the middle portion of the body at a pivot shaft and including a first end having a cutter edge and including a second end having a pin, and a lever including a first end pivotally coupled to the middle portion of the body at a pivot rod and including a second end pivotally coupled to the second end of the bar at a pivot pole, the lever including a middle portion having a groove for slidably engaging with the pin. The pin is caused to move along the groove of the lever for rotating the cutter blade about the pivot shaft when the lever is rotated about the pivot rod, and the pin is provided between the pivot pole and the pivot rod such that the force acting point onto the lever is farther away from the pivot rod then the pin and such that the pin and the cutter blade may be rotated with less force. Accordingly, the shear device may be easily operated by weak people or by children.

The pin may be moved toward or away from the pivot rod of the lever for conducting variable force compound action.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
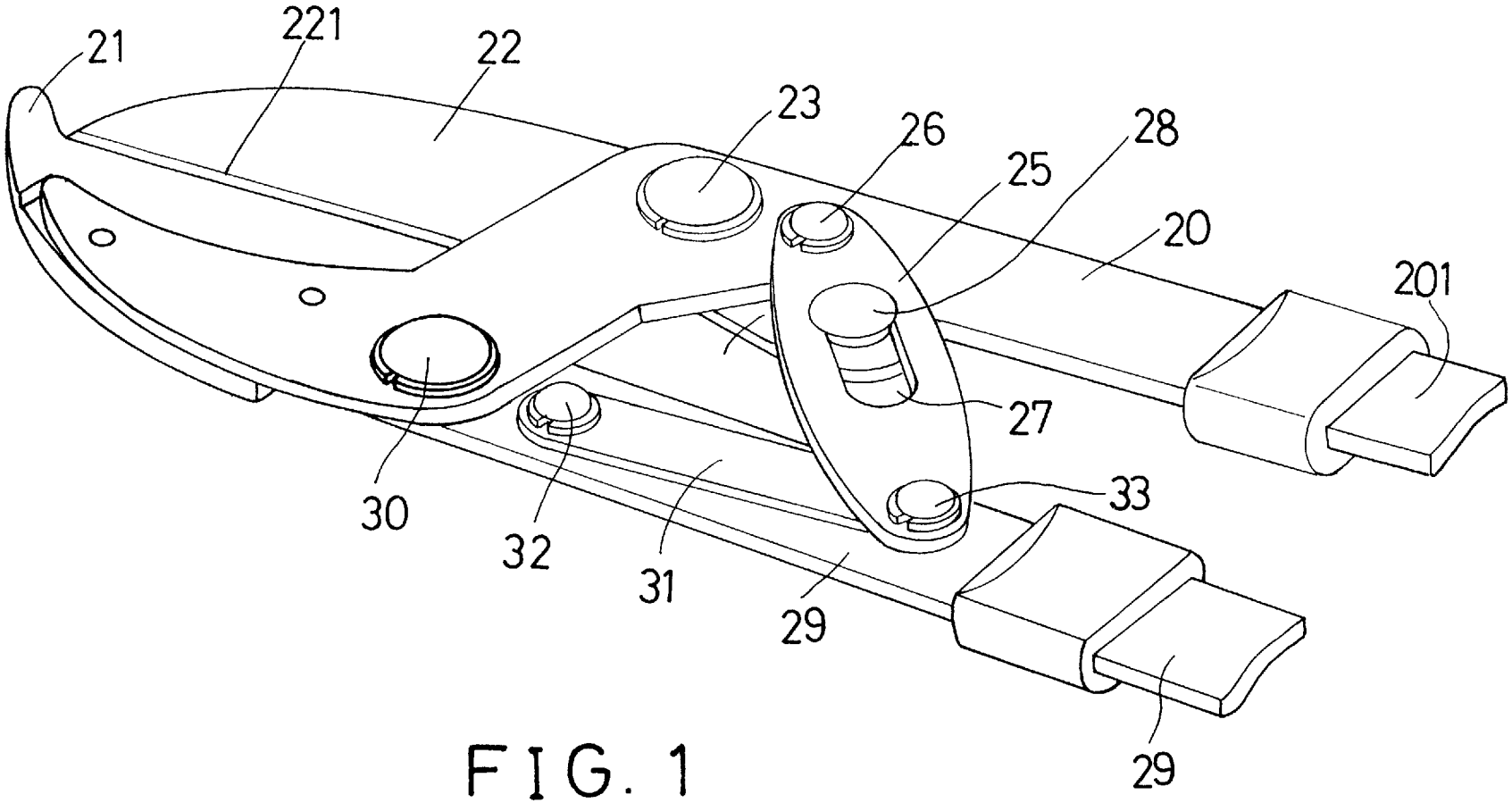
FIG. 1 is a perspective view of a shear device in accordance with the present invention.
Figure 2:
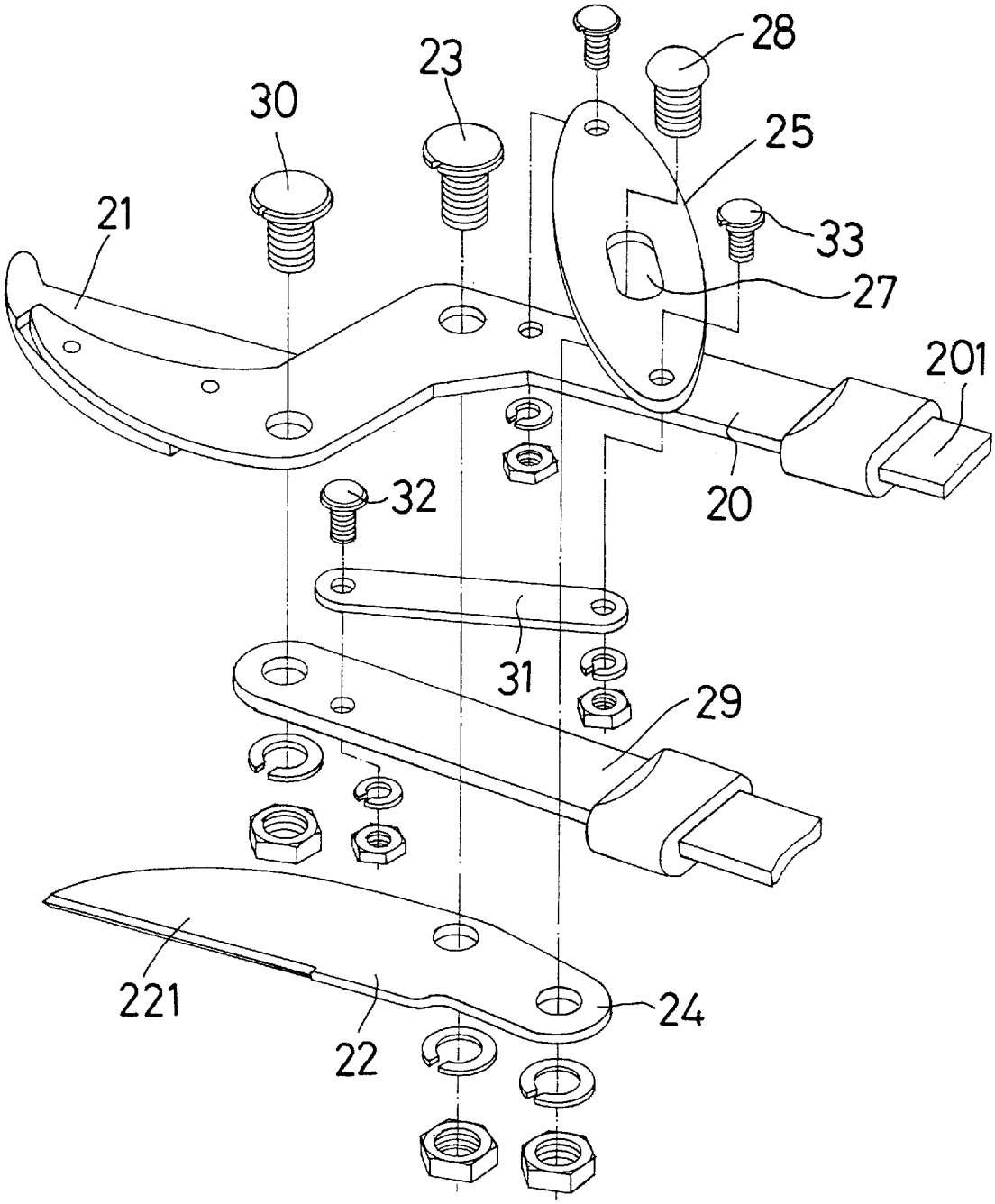
FIG. 2 is an exploded view of the shear device.
Figure 3:
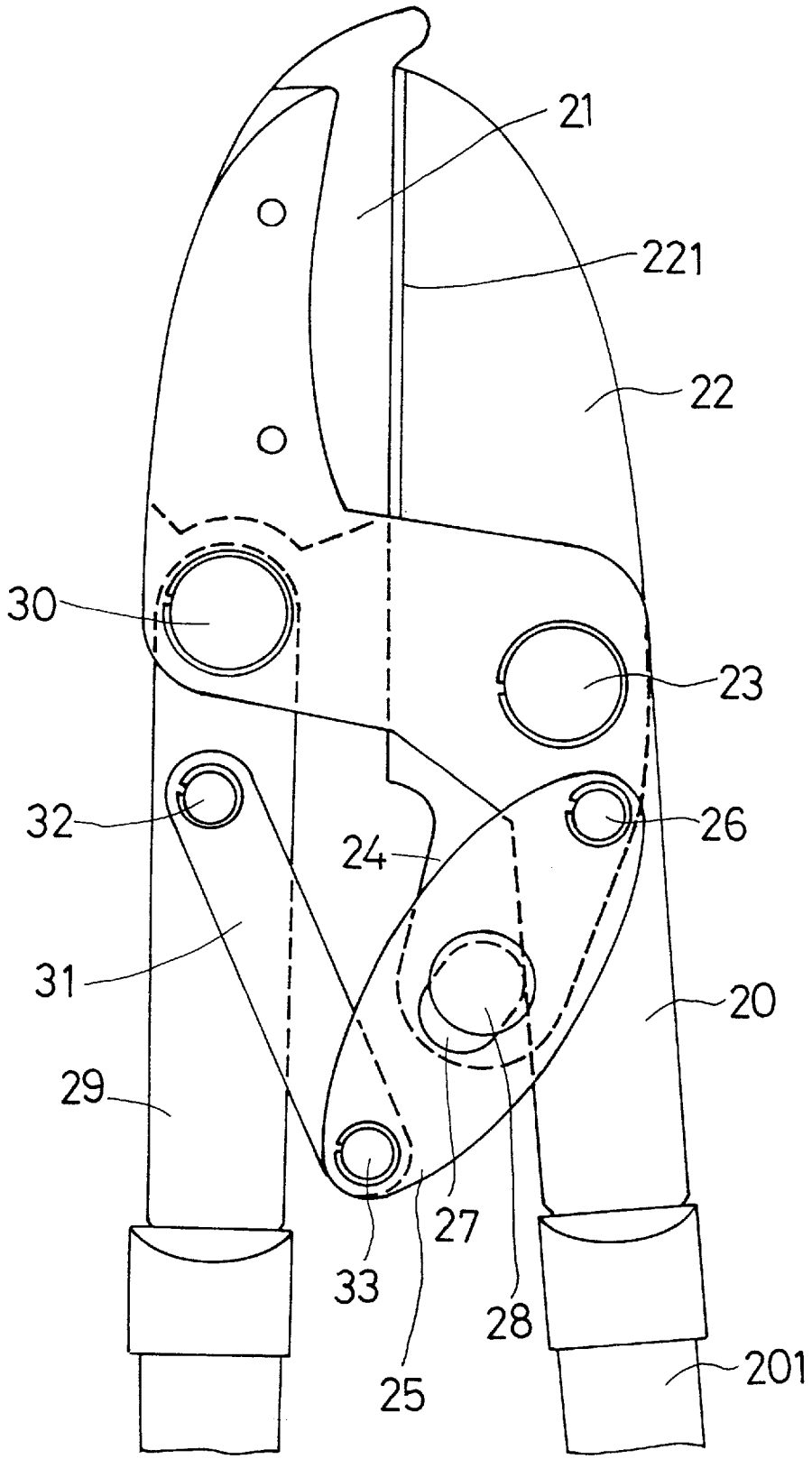
FIGS. 3 and 4 are plane views illustrating the operation of the shear device.
Figure 4:
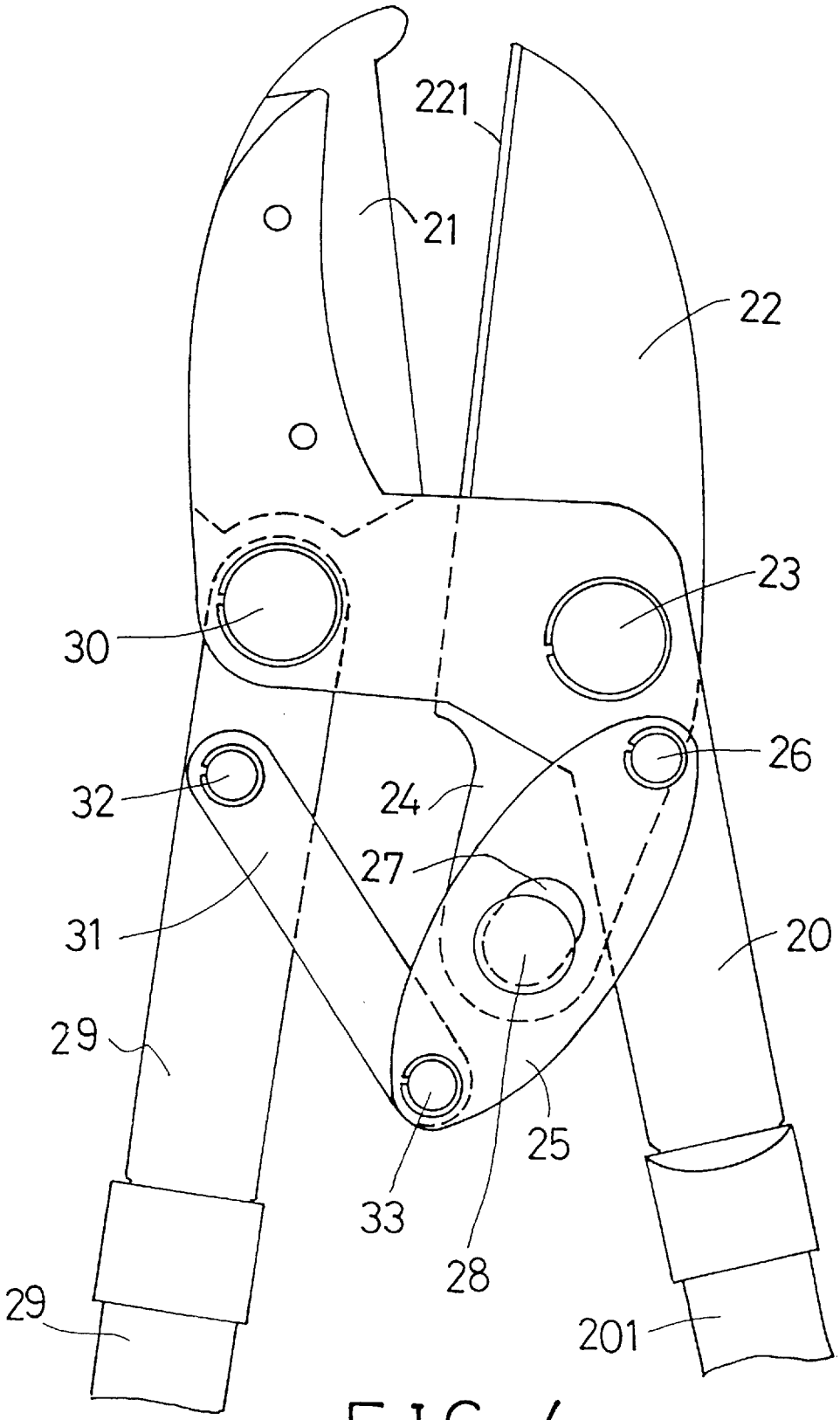

Referring to the drawings, and initially to FIGS. 1–3, a shear device in accordance with the present invention comprises a body 20 including a fixed jaw 21 provided on one end and including a hand grip 201 provided on the other end. A cutter blade 22 has a middle portion pivotally coupled to the middle portion of the body 20 at a pivot shaft 23 and has a pin 28 secured to one end 24 and has a cutter edge 221 provided on the other end. A lever 25 has one end pivotally coupled to the body 20 at a pivot rod 26 and includes a groove 27 for slidably engaging with the pin 28 and for allowing the pin 28 to move from one end of the groove 27 to the other. A handle 29 has one end pivotally coupled to the body 20 at a pivot axle 30. A bar 31 has one end pivotally coupled to the handle 29 at a pin 32 and has the other end pivotally coupled to the other end of the lever 25 at a pivot pole 33.

In operation, the pivot pole 33 may be moved away from the cutter blade 22, and the lever 25 and the bar 31 may be moved toward each other when the body 20 and the handle 29 are forced toward each other. The pin 28 may thus be moved toward or away from the pivot rod 26 for conducting variable force compound action. The distance between the pivot pole 33 and the pivot rod 26 is greater than that between the pin 28 and the pivot rod 26, and the pivot pole 33 is the force acting onto the lever 25 such that the pin 28 and the cutter blade 22 may be actuated with less force and such that the shear device may be operated by weak people or children.

Accordingly, the shear device in accordance with the present invention may be operated with less force and may be easily operated by weak people or children.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A shear device comprising:

a body including a first end having a fixed jaw and including a middle portion and including a second end having a hand grip, a handle pivotally coupled to said body for moving toward and away from said hand grip, a bar including a first end pivotally coupled to said handle and including a second end, a cutter blade including a middle portion pivotally coupled to said middle portion of said body at a pivot shaft and including a first end having a cutter edge and including a second end having a pin, and a lever including a first end pivotally coupled to said middle portion of said body at a pivot rod and including a second end pivotally coupled to said second end of said bar at a pivot pole, said lever including a middle portion having a groove for slidably engaging with said pin, said pin being caused to move along said groove of said lever for rotating said cutter blade about said pivot shaft when said lever is rotated about said pivot rod, and said pin being provided between said pivot pole and said pivot rod for allowing said pin and said cutter blade to be rotated with less force.

* * * * *